US007069216B2

(12) United States Patent
DeMoortel et al.

(10) Patent No.: US 7,069,216 B2
(45) Date of Patent: Jun. 27, 2006

(54) CORPUS-BASED PROSODY TRANSLATION SYSTEM

(75) Inventors: Jan DeMoortel, Rollegem (BE); Justin Fackrell, Ghent (BE); Peter Rutten, Ghent (BE); Bert Van Coile, Bruges (BE)

(73) Assignee: Nuance Communications, Inc., Burlington, MA (US)

( * ) Notice: Subject to any disclaimer, the term of this patent is extended or adjusted under 35 U.S.C. 154(b) by 548 days.

(21) Appl. No.: 09/969,117

(22) Filed: Oct. 1, 2001

(65) Prior Publication Data

US 2002/0152073 A1 Oct. 17, 2002

Related U.S. Application Data

(63) Continuation of application No. 60/236,475, filed on Sep. 29, 2000.

(51) Int. Cl.
*G10L 13/08* (2006.01)

(52) U.S. Cl. ..... 704/260

(58) Field of Classification Search ..... 704/260, 704/277, 239; 395/2.76, 2.67; 381/51; 364/513.5
See application file for complete search history.

(56) References Cited

U.S. PATENT DOCUMENTS 4,994,983 A * 2/1991 Landell et al. ..... 704/245
5,140,639 A * 8/1992 Sprague et al. ..... 704/208
5,636,325 A 6/1997 Farrett ..... 395/2.67
5,740,320 A * 4/1998 Itoh ..... 704/267
5,940,797 A * 8/1999 Abe ..... 704/260
6,064,960 A * 5/2000 Bellegarda et al. ..... 704/260
6,173,262 B1 * 1/2001 Hirschberg ..... 704/260
6,366,883 B1 * 4/2002 Campbell et al. ..... 704/260
6,411,932 B1 * 6/2002 Molnar et al. ..... 704/260
6,499,014 B1 * 12/2002 Chihara ..... 704/260
6,665,641 B1 * 12/2003 Coorman et al. ..... 704/260
6,738,745 B1 * 5/2004 Navratil et al. ..... 704/277

OTHER PUBLICATIONS

Arslan, L. M., et al "Speaker Transformation Using Sentence HMM Based Alignments and Detailed prosody Modification" *Acoustics, Speech and Signal Processing 1998, Proceedings of the 1998 IEEE International Conference on Seattle, USA*, May 12-15, 1998, NY, NY, USA, IEEE, US, May 12, 1998, pp. 289-292, XP010279057, ISBN: 0-7803-4428-6.

(Continued)

*Primary Examiner*—Susan McFadden
*Assistant Examiner*—Jakieda R. Jackson
(74) *Attorney, Agent, or Firm*—Bromberg & Sunstein LLP

(57) ABSTRACT

A method of prosody translation is given. A target input symbol sequence is provided, including a first set of speech prosody descriptors. An instance-based learning algorithm is applied to a corpus of speech unit descriptors to select an output symbol sequence representative of the target input symbol sequence and including a second set of speech prosody descriptors. The second set differs from the first set.

12 Claims, 3 Drawing Sheets

OTHER PUBLICATIONS

Daelemans, A., et al "Rapid Development of NLP Modules with Memory-Based Learning", *Proceedings of ELSNET in Wonderland*, 1998, pp. 105-113, XP002195244, Ulrecht, Netherlands.

Malfrere, F., et al "Automatic Prosody Generation Using Suprasegmental Unit Selection", *Proceedings ofESCA/Cocosda Workshop on speech Synthesis*, 1998, XP002195246, Jenolan Caves, Australia.

McKeown, K. R., et al "Prosody Modelling in Concept-to-Speech Generation: Methodological Issues", *Philosophical Transactions of the Royal society London, Series A* (*A Mathematical, Physical and Engineering Sciences*), Apr. 15, 2002, R. Soc, UK, vol. 358, No. 1769, pp. 1419-1432, XP002195245, ISSN: 1364-503X.

Rutten, P., et al "Issues in Corpus Based Speech Synthesis", *IEE Seminar on State of the Art in Speech Synthesis* (*Ref. No. 00/0058, IEEE Seminar on State of the Art in Speech Synthesis*, London, UK, Apr. 13, 2000, pp. 16/1-7, XPOO1066388 2000, London, UK, IEE, UK.

* cited by examiner

CORPUS-BASED PROSODY TRANSLATION SYSTEM

This application claims benefit 60/236,475 Sep. 29, 2000.

FIELD OF THE INVENTION

The invention relates to text-to-speech systems, and more specifically, to translation of speech prosody descriptions from one prosodic representation to another.

BACKGROUND ART

Prosody refers to characteristics that contribute to the melodic and rhythmic vividness of speech. Some examples of these characteristics include pitch, loudness, and syllabic duration. Concatenative speech synthesis systems that use a small unit inventory typically have a prosody-prediction component (as well as other signal manipulation techniques). But such a prosody-prediction component is generally not able to recreate the prosodic richness found in natural speech. As a result, the prosody of these systems is too dull to be convincingly human.

One previous approach to prosody generation used instance-based learning techniques for classification [See, for example, "Machine Learning", Tom M. Mitchell, McGraw-Hill Series in Computer Science, 1997; incorporated herein by reference]. In contrast to learning methods that construct a general explicit description of the target function when training examples are provided, instance-based learning methods simply store the training examples. Generalizing beyond these examples is postponed until a new instance must be classified. Each time a new query instance is encountered, its relationship to the previously stored examples is examined in order to assign a target function value for the new instance. The family of instance-based learning includes nearest neighbor and locally weighted regression methods that assume instances can be represented as points in a Euclidean space. It also includes case-based reasoning methods that use more complex, symbolic representations for instances. A key advantage to this kind of delayed, or lazy, learning is that instead of estimating the target function once for the entire space, these methods can estimate it locally and differently for each new instance to be classified.

One specific approach to prosody generation using instance-based learning was described in F. Malfrère, T. Dutoit, P. Mertens, "Automatic Prosody Generation Using Suprasegmental Unit Selection," in Proc. of ESCA/COCOSDA Workshop on Speech Synthesis, Jenolan Caves, Australia, 1998; incorporated herein by reference. A system is described that uses prosodic databases extracted from natural speech to generate the rhythm and intonation of texts written in French. The rhythm of the synthetic speech is generated with a CART tree trained on a large mono-speaker speech corpus. The acoustic aspect of the intonation is derived from the same speech corpus. At synthesis time, patterns are chosen on the fly from the database so as to minimize a total selection cost composed of a pattern target cost and a pattern concatenation cost. The patterns that are used in the selection mechanism describe intonation on a symbolic level as a series of accent types. The elementary units that are used for intonation generation are intonational groups which consist of a sequence of syllables. This prosody generation algorithm is currently freely available from the EULER framework for the development of TTS systems for non-commercial and non-military applications at http://tcts.fpms.ac.be/synthesis/euler.

U.S. Pat. No. 5,905,972 "Prosodic Databases Holding Fundamental Frequency Templates For Use In Speech Synthesis" (incorporated herein by reference) describes an algorithm that is very similar to the one in Malfrère et al. Prosodic templates are identified by a tonal emphasis marker pattern, which is matched with a pattern that is predicted from text. The patterns (or templates) consist of a sequence of tonal markings applied on syllables: high emphasis, low emphasis, no special emphasis. Only fundamental frequency (f0) contours are generated by this method, no phoneme duration.

DETAILED DESCRIPTION OF SPECIFIC EMBODIMENTS

Figure 1:
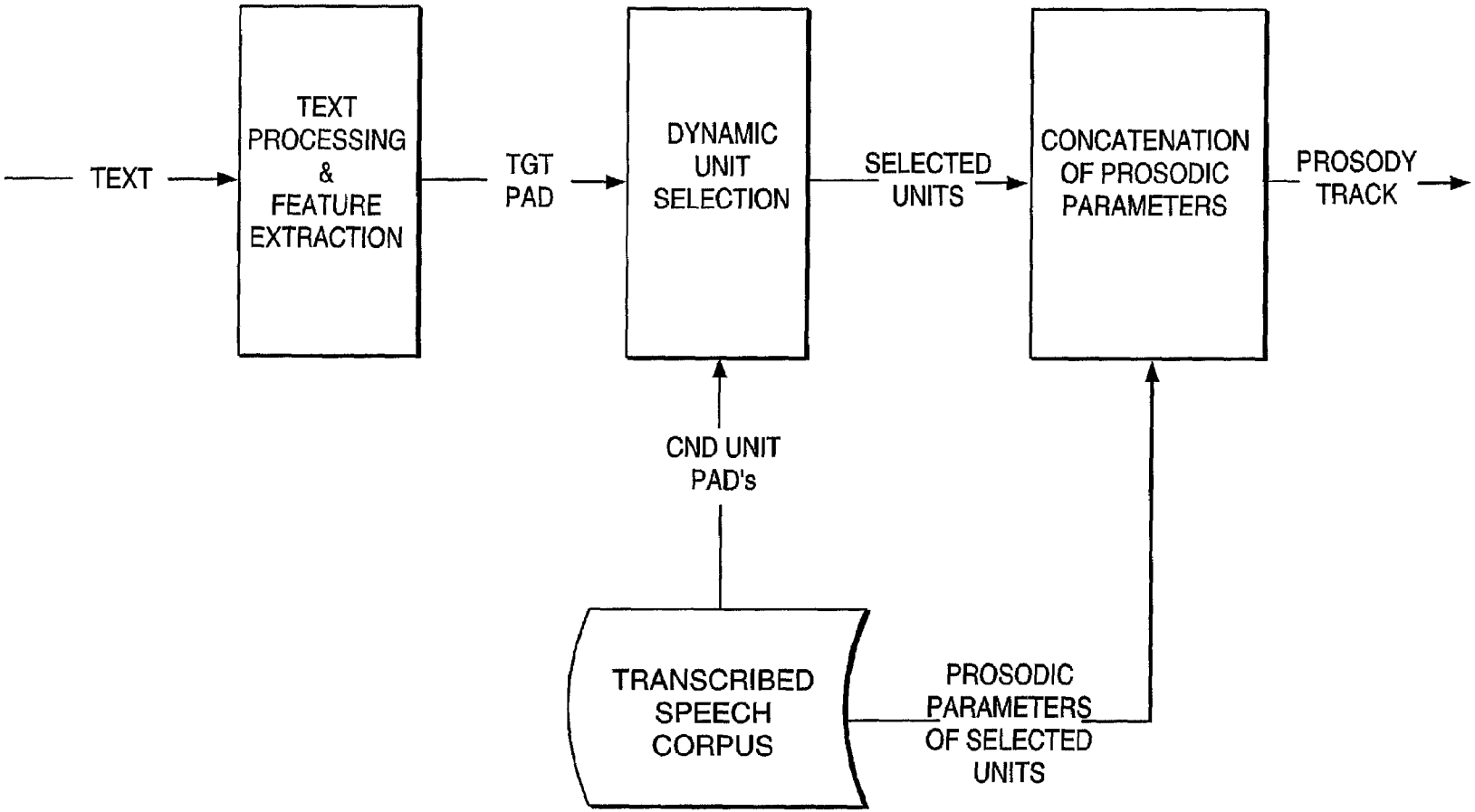
FIG. 1 describes the basic building blocks of a corpus-based prosody generation system.

Embodiments of the present invention include a corpus-based prosody translation method using instance-based learning. Training data consists of a large database of natural speech descriptions, including a description of the prosodic realization called a prosody track (defined in the Glossary below). The prosody track may contain a broad description (e.g., coded contours), a narrow description (e.g., acoustic information such as pitch, energy and duration), and/or a description between these extremes (e.g., syllable-based ToBI labels, sentence accents, word-based prominence labels). The descriptions can also be considered as hierarchical, from high level symbolic descriptions such as word prominence and sentence accents; through medium level descriptions such as ToBI labels; to low level acoustic descriptions such as pitch, energy, and duration.

One or more of these prosody tracks for a particular input message (see the Glossary) is intended to be mapped to one or more other prosody tracks. In a prosody prediction application such as TTS, a high- or medium-level input prosody track is converted to a low-level prosody track output. In a prosody labeling application such for prosody scoring in an educational language-tutoring system, a low-level input is converted to a high-level prosody track output. Some differences between the prior art approaches and the approach that we describe include:

Feature vector matching is used, as opposed to the string matching of the prior art (sequence of diphone feature vectors v. sequence of tone symbols).

Features are based on an information-rich phoneme aligned transcription and are not limited to sequence of syllable-based tone markers as in the prior art.

Our approach utilizes predicted f0 contours of intonation groups assembled from very small chunks (e.g., diphones) rather than large chunks (e.g., Malfrère, manipulated complete sentences or phrases). Our approach produces a greater variation in the speech output result.

We predict f0 and duration rather than just f0.

Our approach uses a novel choice of short speech units (SSUs—see the Glossary) as the elementary speech units for speech synthesis prosody prediction (mapping a higher-level prosody track to a lower-level prosody track). Previously, prosody prediction used syllables or even larger units as typical elementary speech units. This was because prosody traditionally was viewed as a supra-segmental phenomenon. So it seemed logical to base unit selection on a supra-segmental elementary speech unit. In the past, SSUs such as diphones were introduced mainly to incorporate coarticulation effects for concatenative speech synthesis systems, not to solve a prosody prediction problem. But we choose to generate prosody using SSUs as the elementary speech unit.

An important advantage of using small units to assemble a new prosodic contour is that more prosodic variation results than when large prototype contours are used. Symbolic descriptions of prosody can be based on various different kinds of phonetic or prosodic units—including syllables (e.g., ToBI, sentence accents) and words (e.g., word prominence, inter-word prosodic boundary strength). Acoustic descriptions of prosody, however, relate to a different smaller scale. For SSUs, the acoustic description can include pitch average and pitch slope, to describe a linear approximation of pitch in a demiphone. This description can be sufficient for dynamic unit selection (as described below).

The translated prosodic description is created by combining specific prosody tracks of SSUs that: (1) match symbolically with the input description, (2) match acoustically to each other at their join points, and (3) match acoustically to a number of context dependent criteria. If only the first criterion was taken into account, a k-Nearest Neighbor algorithm could solve the problem. But the second and third criteria demand a more elaborate approach such as the dynamic unit selection algorithm that is typically used for speech waveform selection in concatenative speech synthesis systems. There are a number of speech-related applications that can use such a system, as outlined in Table 1.

From a phonetic specification (e.g., from a text processor output) known as a target, a typical embodiment produces a high quality prosody description by concatenating prosody tracks of real recorded speech. FIG. 1 provides a broad functional overview of such a prosody translation engine. The main blocks of the engine include a feature extraction text processor 101, a speech unit descriptor (SUD—see Glossary) database 104 having descriptions of a vocabulary of small speech units (SSUs), a dynamic unit selector 106, and a segmental prosody concatenator 108.

The feature extraction text processor 101 converts a text input 102 into a target phoneme-aligned description (PAD—see Glossary) 103 output to the dynamic unit selector 106. The target PAD 103 is a multi-layer internal data sequence that includes phonetic descriptors, symbolic descriptors, and prosodic descriptors. The phonetic descriptors of the target PAD 103 can store prosodic parameters determined by linguistic modules within the text processor 101 (e.g., prediction of phrasing, accentuation, and phoneme duration).

The speech units in the SUD database 104 are organized by SSU classes that are defined based on phonetic classes. For example, two phoneme classes can define a diphone class in the same way that two phonemes define a diphone. Phoneme classes can vary from very narrow to very broad. For example, a narrow phoneme class might be based on phonetic identity according to the theory of phonetics to produce a phoneme→class mapping such as /p/→p and /d/→d. On the other hand, an example of a broad phoneme class might be based on a voiced/unvoiced classification such that the phoneme→class mapping contains mappings such as /p/→U (unvoiced) and /d/→V (voiced).

Figure 2:
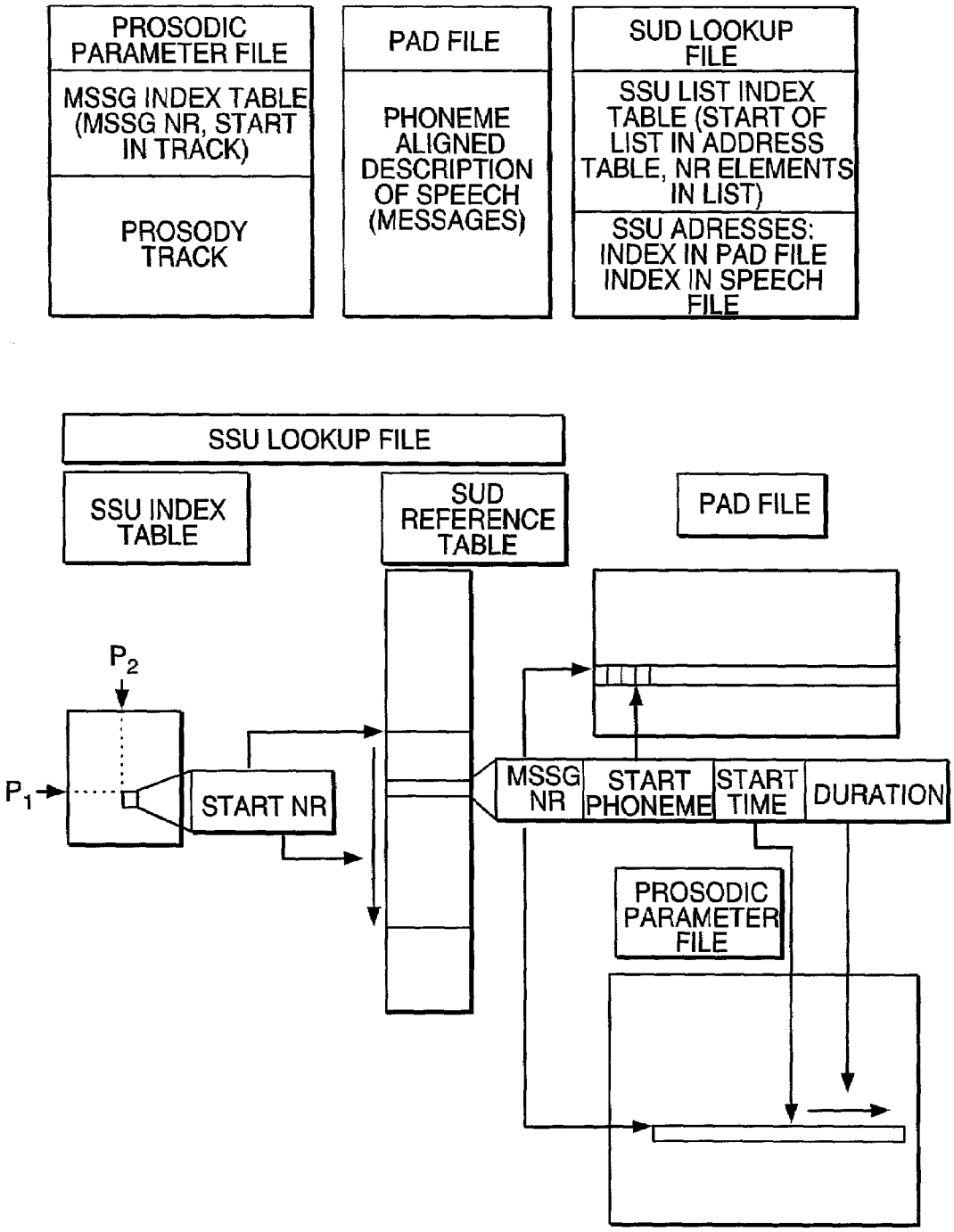
FIG. 2 describes the database organization.

FIG. 2 shows the organization of the SUD database 104 in FIG. 1. There are three types of files: (1) a prosodic parameter file 201, (2) a phoneme aligned description (PAD) file 202, and (3) a short speech unit (SSU) lookup file 203. The prosodic parameter file 201 contains prosodic parameters that are not used for unit selection. These can include measured pitch values, symbolic representations of pitch tracks, etc. The PAD file 202 contains the phoneme-aligned descriptions of speech that are used for unit selection. This includes two types of data: (1) symbolic features that can be derived from text, and (2) acoustic features that are derived from a recorded speech waveform. Table 2 in the Tables Appendix illustrates part of the PAD file 202 of an example message: "You couldn't be sure he was still asleep." Table 3 describes the various symbolic features, and Table 4 describes the acoustic features.

The SSU lookup file 203 is a table based on phoneme class that contains references of the SSUs in the PAD file 202 and prosodic parameter file 201. Within the SSU lookup file 203, an SSU class index table 204 contains an entry for each SSU phoneme class. These entries describe the location in an SSU reference table 205 of the SSU references belonging to that class. Each SSU reference in the SSU reference table 205 contains a message number for the location of the utterance in the PAD file 202, the phoneme in the PAD file 202 where that SSU starts, the starting time of that SSU in the prosodic parameter file 201, and the duration of that SSU in the prosodic parameter file 201.

The unit selector 106 in FIG. 1 receives a stream of target PADs 103 from the text processor 101 and retrieves descriptors of matching candidate unit PADs 105 from the SUD database 104. Matching means simply that the SSU classes match. A best sequence of selected units 107 is chosen as the sequence having the smallest accumulated matching costs, which can be found efficiently using Dynamic Programming techniques. The unit selector 106 provides the sequence of selected units 107 as an output to the segmental prosody concatenator 108.

In a typical embodiment, the unit selector 106 calculates a "node cost" (a term taken from Dynamic Programming) for each target unit based on the features that are available from the target PADs 103 and the candidate unit PADs 105. The fit of each candidate to the target specification is determined based on symbolic descriptors (such as phonetic context and prosodic context) and numeric descriptors. Poorly matching candidates may be excluded at this point.

The unit selector 106 also typically calculates "transition costs" (another term from Dynamic Programming) based on acoustic information descriptions of the candidate unit PADs 105 from the SUD database 104. The acoustic information descriptions may include energy, pitch and duration information. The transition cost expresses the error contribution (prosodic mismatch) between successive node elements in a matrix from which the best sequence is chosen. This in turn indicates how well the candidate SSUs can be joined together without causing disturbing prosody quality degradations such as large pitch discontinuities, large rhythm differences, etc.

The effectiveness of the unit selector 106 is related to the choice of cost functions and to the method of combining the costs from the various features. One specific embodiment uses of a family of complex cost functions as described in U.S. patent application Ser. No. 09/438,603, filed Nov. 12, 1999, and incorporated herein by reference.

The segmental prosody concatenator 108 requests the prosodic parameter tracks 109 of the selected units 107 from the SUD database 104. The individual prosody tracks of the selected units 107 are concatenated to form an output prosody track 110 that corresponds to for the target input text 102. The prosodic parameter tracks 109 can be smoothed by interpolation. After unit selection is performed once for a particular input text 102, multiple prosody track outputs 110 can be extracted from the best sequence of candidates—each output representing the evolution in time of a different prosodic parameter. For example, after a single unit selection operation, one specific embodiment can extract all of the following prosody track outputs 110: ToBI labels (labels expressed as a function of syllable index), prominence labels (labels expressed as a function of word index), and a pitch contour (pitch expressed as a function of time).

Application of a Corpus-Based Prosody Generator in a TTS System

Figure 3:
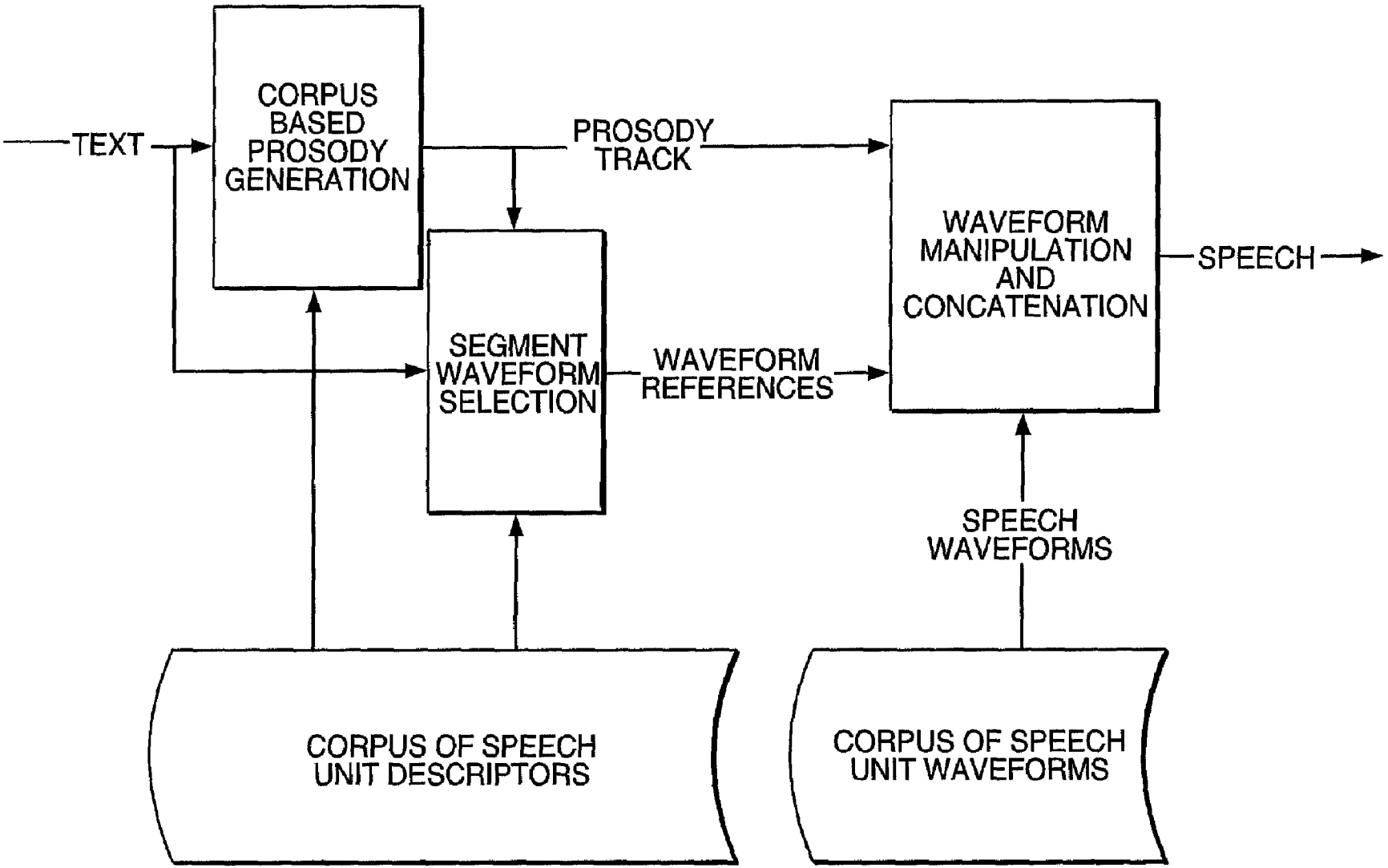
FIG. 3 describes an application of a corpus-based prosody generation system in a speech synthesizer.

FIG. 3 shows a corpus-based text-to-speech synthesizer application that uses a prosody translation system for prosody prediction. The system depicted is typical in that it has both a speech unit descriptor corpus 301 containing transcriptions of speech waveforms, and a speech unit waveform corpus 302 containing the waveforms themselves. Usually, the waveform corpus 302 is much larger than the descriptor corpus 301, and it can be useful to apply a downscaling mechanism to satisfy system memory constraints.

This downscaling can be realized by using a corpus-based prosody generator 303. The general approach is to remove actual waveforms from the waveform corpus 302, but at the same time keep the full transcription of these waveforms available in the descriptor corpus 301. The prosody generator 303 uses this full descriptor corpus 301 to create the prosody track 304 for the speech output 305 from the target input text 306. The waveform selector 307 can then take the generated prosody track 304 as one of the features used to select waveform references 308 from the descriptor corpus 301 for the waveform concatenator 309. The waveform concatenator 309 uses these waveform references 308 to determine which speech unit waveforms 310 to retrieve from the waveform corpus 302. The prosody track 304 generated by the corpus-based prosody generator 303 can also be used by the waveform concatenator 309 to adjust the prosodic parameters of the retrieved speech unit waveforms 310 before they are concatenated to create the desired synthetic speech output 305.

Most of the foregoing description relates to the application of an embodiment for prosody prediction in a text-to-speech synthesis system. But the invention is not limited to text-to-speech synthesis and can be useful in a variety of other applications. These include without limitation use as a prosody labeler in a speech tutoring system to guide someone learning a language, use as a prosody labeling tool to produce databases for prosody research, and use in an automatic speech recognition system.

This scalable corpus-based system can combine the corpus-based synthesis approach with the small unit inventory approach. The properties of three types of systems are compared below:

| | DB size | | Unit selection | Prosody model | | Signal manipulation | | Quality | |
|---|---|---|---|---|---|---|---|---|---|
| Type of system | Symbolic | Speech | complexity | Broad | Narrow | Concatenation | Prosody manipulation | Voice | Prosody |
| Small unit inventory | Very small | Small | Very low | Yes | Yes | Yes | Yes | Low | Low |
| Corpus-based | Large | Large | High | Yes | No | Yes | No | High | High |
| Scalable Corpus-based | Large | Small or Medium | High (pros) Low (speech) | Yes | No | Yes | Yes | Low or Medium | High |

| Glossary | |
|---|---|
| Message | a sequence of symbols representing a spoken utterance—this can be a word, a phrase, a sentence, or a longer utterance. The message can be concrete—i.e., based on an actual recording of a human (e.g., as contained in the database of the prosody translation system) or virtual—e.g., as in the user-defined input to a TTS system. |
| Prosody track | a sequence of numbers or symbols which define how prosody evolves over time. If a coarse description of prosody is used, the descriptors can be, for example, word-based prominence, prosodic boundary strength, and/or syllable duration. A more refined description can consist of, for example, pitch patterns and/or ToBI labels. A fine description typically consists of the pitch value, measured within a small time interval, and the phone duration. |
| SSU | short speech unit. A short speech unit is a segment of speech that is short in terms of the number of phones it contains, typically shorter than the average phonemic length of a syllable. These units can be, for example, demiphones, phones, diphones. |
| Demiphone | a speech unit that consists of half a phone. |
| Diphone | a speech unit that consists of the transition from the center of one phoneme to the center of the following one. |
| SUD | a speech unit descriptor, containing all the relevant information that can be derived from a recorded speech signal. Speech unit descriptors include symbolic descriptors (e.g., lexical stress, word position, etc.) and prosodic descriptors (e.g., duration, amplitude, pitch, etc.) These prosodic descriptors are derived from the prosodic data, and can be used to simplify the unit selection process. |
| PAD | phoneme-aligned description of a speech. An example is shown in Table 2. |

TABLE 1

Potential Applications of the invention.

| | | level of description of prosody tracks | |
|---|---|---|---|
| Application | use | input | output |
| Text-to-speech | prosody prediction | high-level (e.g., lexical stress + sentence accents) | medium level (e.g., ToBI) |

TABLE 1-continued

Potential Applications of the invention.

| Application | use | level of description of prosody tracks input | output |
|---|---|---|---|
| | | medium level (e.g., ToBI) | low-level (pitch, amplitude, energy) |
| Prosodic database creation | Prosody labeling | low-level (pitch, energy, duration) | medium (e.g., ToBI) |
| Language learning | Prosody labeling (to facilitate scoring a learner's prosody) | low-level (pitch, energy, duration) | medium (e.g., ToBI) |
| Word recognition | prosody labeling (to map pitch, duration, energy to a prosodic label) | low-level (pitch, energy, duration) | high level (syllabic stress, word prominence) |

TABLE 3-continued

Symbolic features used in the example PAD.
SYMBOLIC FEATURES

| Name & acronym | Possible values | applies to |
|---|---|---|
| Sentence accent Sent__acc | (S)tressed (U)nstressed | syllable |
| Prominence PROMINENCE | 0 1 2 3 | syllable |
| Tone value (optional) TONE | X(missing value) L(ow tone) R(ising tone) H(igh tone) F(alling tone) | syllable (mora) |
| Syllable position in word SYLL__IN__WRD | I(nitial) M(edial) F(inal) | syllable |
| Syllable count in phrase (from first) Syll__count-> | 0 . . . N-1 (N = nr syll in phrase) | syllable |

TABLE 2

Example of a phoneme-aligned description of speech
PAD: 26 phonemes-2029.400024 ms-CLASS: S

| PHONEME: | # | Y | k | U | d | n | b | i | S | U |
|---|---|---|---|---|---|---|---|---|---|---|
| DIFF: | 0 | 0 | 0 | 0 | 0 | 0 | 0 | 0 | 0 | 0 |
| SYLL__BND: | S | S | A | B | A | B | A | B | A | N |
| BND__TYPE->: | N | W | N | S | N | W | N | W | N | N |
| SENT__ACC: | U | U | S | S | U | U | U | U | S | S |
| PROMINENCE: | 0 | 0 | 3 | 3 | 0 | 0 | 0 | 0 | 3 | 3 |
| TONE: | X | X | X | X | X | X | X | X | X | X |
| SYLL__IN__WRD: | F | F | I | I | F | F | F | F | F | F |
| SYLL__IN__PHRS: | L | 1 | 2 | 2 | M | M | P | P | L | L |
| syll__count->: | 0 | 0 | 1 | 1 | 2 | 2 | 3 | 3 | 4 | 4 |
| syll__count<-: | 0 | 4 | 3 | 3 | 2 | 2 | 1 | 1 | 0 | 0 |
| SYLL__IN__SENT: | I | I | M | M | M | M | M | M | M | M |
| NR__SYLL__PHRS: | 1 | 5 | 5 | 5 | 5 | 5 | 5 | 5 | 5 | 5 |
| WRD__IN__SENT: | I | I | M | M | M | M | M | M | f | f |
| PHRS__IN__SENT: | n | n | n | n | n | n | n | n | n | n |
| Phon__Start: | 0.0 | 50.0 | 120.7 | 250.7 | 302.5 | 325.6 | 433.1 | 500.7 | 582.7 | 734.7 |
| Mid__F0: | −48.0 | 23.7 | −48.0 | 27.4 | 27.0 | 25.8 | 24.0 | 22.7 | −48.0 | 23.3 |
| Avg__F0: | −48.0 | 23.2 | −48.0 | 27.4 | 26.3 | 25.7 | 23.8 | 22.4 | −48.0 | 23.2 |
| Slope__F0: | 0.0 | −28.6 | 0.0 | 0.0 | −165.8 | −2.2 | 84.2 | −34.6 | 0.0 | −29.1 |

TABLE 3

Symbolic features used in the example PAD.
SYMBOLIC FEATURES

| Name & acronym | Possible values | applies to |
|---|---|---|
| Phonetic differentiator DIFF | User defined annotation symbols will be mapped to 0(not annotated) 1(annotated with first symbol) 2(annotated with second symbol) etc. | phoneme |
| Phoneme position in syllable SYLL__BND | A(fter syllable boundary) B(efore syllable boundary) S(urrounded by syllable bounda-ries) N(ot near syllable boundary) | phoneme |
| Type of boundary following phoneme BND__TYPE-> | N(o) S(yllable) W(ord) P(hrase) | phoneme |
| Lexical stress Lex__str | (P)rimary (S)econdary (U)nstressed | syllable |

TABLE 3-continued

Symbolic features used in the example PAD.
SYMBOLIC FEATURES

| Name & acronym | Possible values | applies to |
|---|---|---|
| Syllable count in phrase (from last) Syll__count<- | N-1 . . . 0 (N = nr syll in phrase) | syllable |
| Syllable position in phrase SYLL__IN__PHRS | 1(first) 2(second) I(nitial) M(edial) F(inal) P(enultimate) L(ast) | syllable |
| Syllable position in sentence SYLL__IN__SENT | I(nitial) M(edial) F(inal) | syllablle |
| Number of syllables in phrase NR__SYLL__PHRS | N(number of syll) | phrase |
| Word position in sentence | I(nitial) M(edial) | word |

TABLE 3-continued

| Symbolic features used in the example PAD. SYMBOLIC FEATURES | | |
|---|---|---|
| Name & acronym | Possible values | applies to |
| WRD_IN_SENT | f(inal in phrase, but sentence medial)<br>i(initial in phrase, but sentence medial)<br>F(inal) | |
| Phrase position in sentence PHRS_IN_SENT | n(ot final)<br>f(inal) | phrase |

TABLE 4

| Acoustic features used in the example PAD ACOUSTIC FEATURES | | |
|---|---|---|
| name & acronym | Possible values | applies to |
| start of phoneme in signal Phon_Start | 0 . . . length_of_signal | phoneme |
| pitch at diphone boundary in phoneme Mid_F0 | Expressed in semitones | diphone boundary |
| average pitch value within the phoneme Avg_F0 | Expressed in semitones | phoneme |
| pitch slope within phoneme Slope_F0 | Expressed in semitones per second | phoneme |

We claim:

1. A method of translating speech prosody comprising:

providing a target input symbol sequence including a first set of speech prosody descriptors; and applying an instance-based learning algorithm to a corpus of speech unit descriptors to select an output symbol sequence representative of the target input symbol sequence and including a second set of speech prosody descriptors, the second set differing from the first set.

2. A method according to claim 1, wherein the speech unit descriptors are associated with short speech units (SSUs).

3. A method according to claim 2, wherein the SSUs are diphones.

4. A method according to claim 2, wherein the SSUs are demi-phones.

5. A method according to claim 1, wherein the target input symbol sequence is produced by processing an input text sequence to extract prosodic features.

6. A method according to claim 1, further comprising concatenating the output symbol sequence to produce an output prosody track corresponding to the target input symbol sequence for use by a speech processing application.

7. A method according to claim 6, wherein the speech processing application includes a text-to-speech application.

8. A method according to claim 6, wherein the speech processing application includes a prosody labeling application.

9. A method according to claim 6, wherein the speech processing application includes an automatic speech recognition application.

10. A method according to claim 1, wherein the algorithm determines accumulated matching costs associated with candidate sequences of speech unit descriptors in the corpus representative of the how well each candidate sequence matches the target input symbol sequence, such that the output symbol sequence represents the candidate sequence having the smallest accumulated matching costs.

11. A method according to claim 10, wherein the matching costs include a node cost representative of the how well symbolic descriptors in the candidate sequence match symbolic descriptors in the target input symbols sequence.

12. A method according to claim 10, wherein the matching costs include a transition cost representative of how well acoustic descriptors in the candidate sequence match acoustic descriptors in the target input symbol sequence.

* * * * *